United States Patent [19]

Piatt, Jr.

[11] Patent Number: 4,936,805

[45] Date of Patent: Jun. 26, 1990

[54] LIFE VEST WITH BACK BRACE

[76] Inventor: James R. Piatt, Jr., 432 Camelback Rd., Pleasant Hill, Calif. 94523

[21] Appl. No.: 224,160

[22] Filed: Jul. 26, 1988

[51] Int. Cl.[5] ..... B63C 9/08

[52] U.S. Cl. ..... 441/106; 411/108

[58] Field of Search ..... 441/106, 107, 108, 111, 441/112, 113, 114, 117, 118, 103, 125; 128/78; 114/315

[56] References Cited

U.S. PATENT DOCUMENTS

| | | | |
|---|---|---|---|
| 3,159,854 | 12/1964 | Covacevich | 441/125 |
| 3,398,406 | 8/1968 | Waterbury | 441/103 |
| 3,733,631 | 5/1973 | Cohn | 441/113 |
| 4,137,585 | 2/1979 | Wright | 441/116 |
| 4,551,107 | 11/1985 | Scheurer et al. | 441/112 |
| 4,820,221 | 4/1989 | Aubrey | 441/106 |

*Primary Examiner*—Sherman D. Basinger
*Assistant Examiner*—Stephen P. Avila

[57] ABSTRACT

A water ski vest is provided with a back brace for supporting the back of a skier. The back brace is positioned on the outside of the back portion of the vest, and an adjustable waist strap is attached to the back brace and extends through slots in the vest so that the back brace can be pulled tightly against the back. Additional straps extend around the outside of the back brace and the vest.

7 Claims, 2 Drawing Sheets

FIG. 3
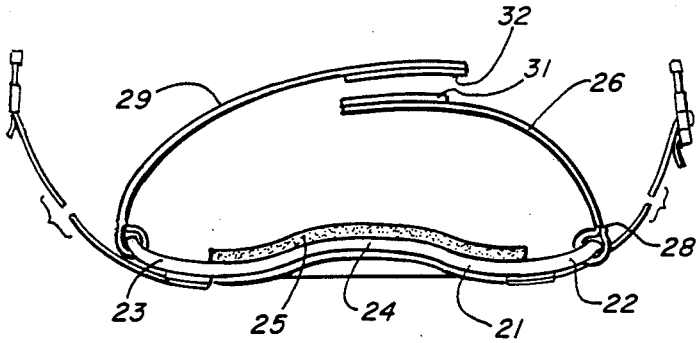
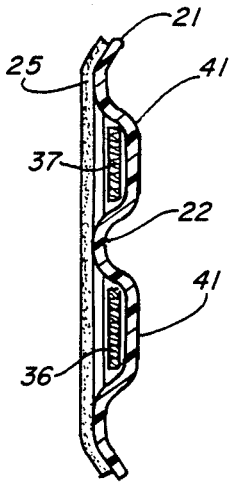
FIG. 6
FIG. 4
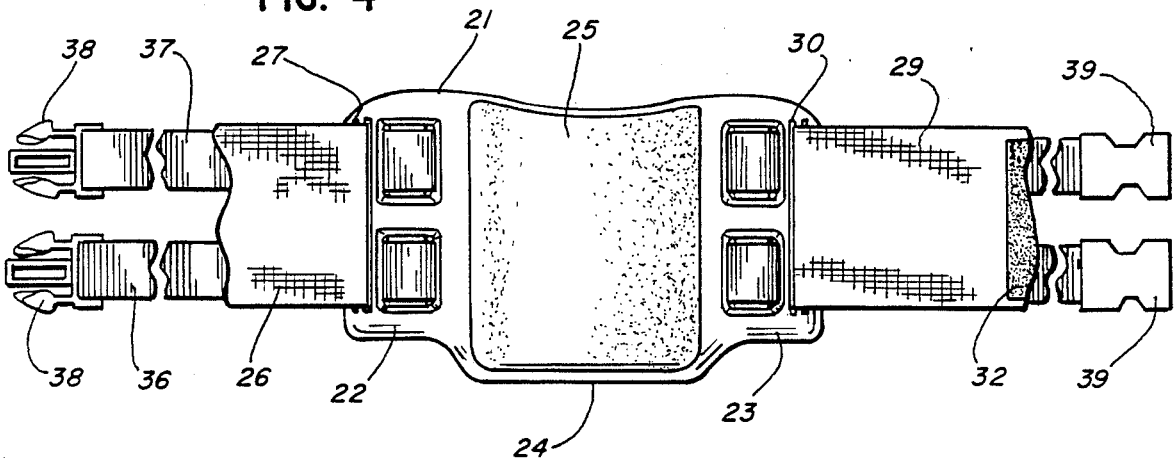
FIG. 5
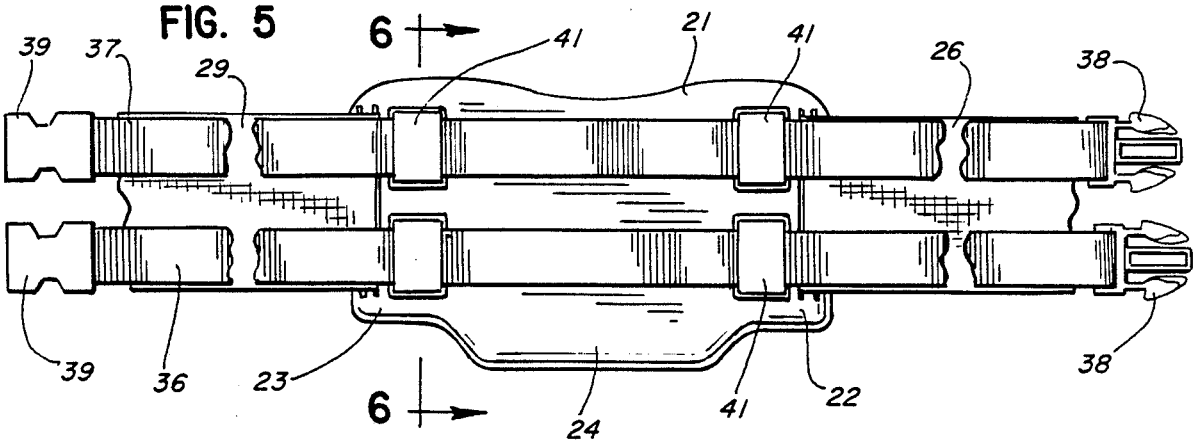

LIFE VEST WITH BACK BRACE

BACKGROUND AND SUMMARY

This invention relates to life vests, and, more particularly, to a life vest with a built-in back brace.

The invention is particularly useful in life vests or personal flotation devices used by water skiers. A water skier often experiences stress to his back as he is pulled across the water by the tow rope. Stress is particularly likely when the skier exerts a strong pull against the tow rope during high speed wake crossings, during slalom turns, or during deep-water starts.

The invention provides a water ski vest with a back brace which supports the back and protects the kidneys while simultaneously providing the flotation necessary to meet Coast Guard standards. The back brace can be pulled tightly against the back to support the mid and lower back muscles, thereby enabling a skier to initiate a stronger pull The back brace also provides protection and support for a skier who has previously injured his back and reduces the likliehood of additional injury.

DESCRIPTION OF THE DRAWING

The invention will be explained in conjunction with an illustrative embodiment shown in the accompanying drawing, in which

FIG. 3 is a top plan view, partially broken away, of the back brace of the life vest;

FIG. 4 is a front elevational view, partially broken away, of the back brace;

FIG. 5 is a rear elevational view, partially broken away, of the back brace; and FIG. 6 is a sectional view taken along the line 6—6 of FIG. 5.

DESCRIPTION OF SPECIFIC EMBODIMENT

Figure 1:
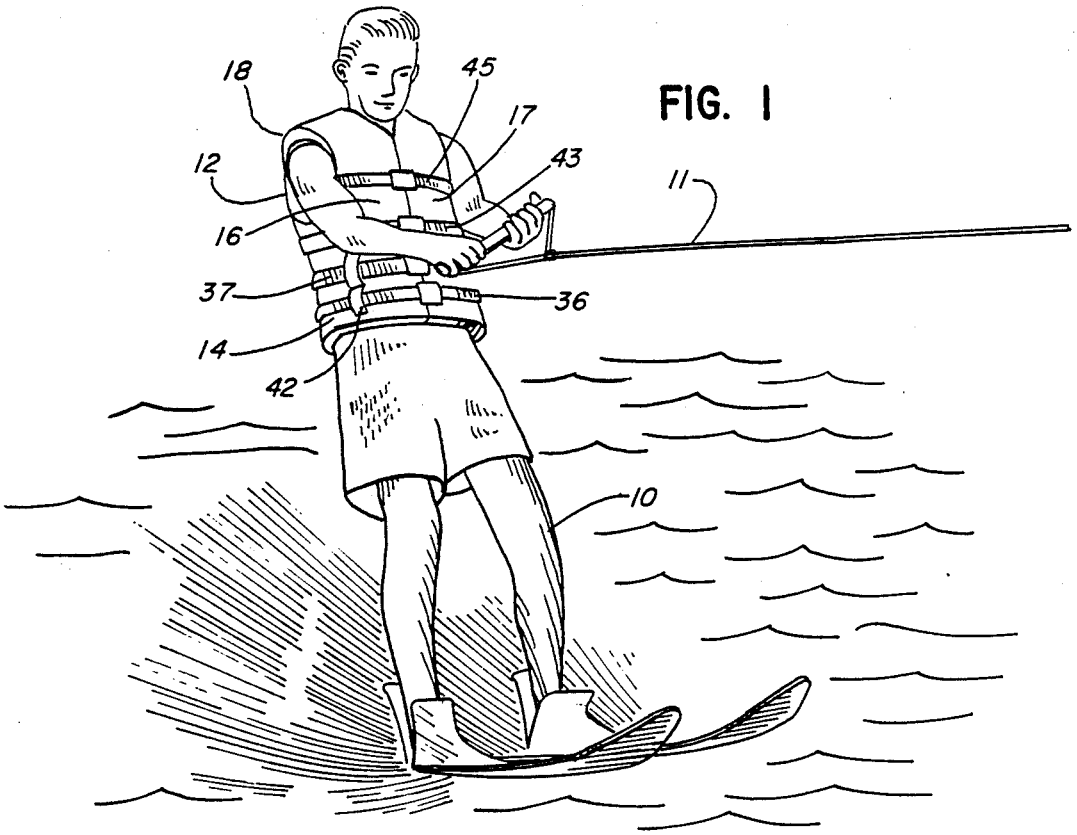
FIG. 1 is a perspective view showing a water skier wearing a life vest formed in accordance with the invention.

FIG. 1 illustrates a water skier 10 being pulled by a tow rope 11. The skier is wearing a life vest or personal flotation device 12 which provides flotation to the skier when the skier is in the water.

The water ski vest 12 includes a back portion 13 which covers the back of the skier, a pair of side portions 14 and 15, a pair of front portions 16 and 17, and a pair of shoulder portions 18 and 19. The material of the vest 12 can be conventional. For example, the vest can be made of an outer nylon fabric shell which encloses conventional flotation material. Alternatively, the vest 12 can be molded from open-celled polyurethane with a vinyl outside cover or skin or can be made from neoprene rubber or nylon II. The particular vest illustrated is comprised of a nylon fabric shell and flotation material inside the shell. The vest supplies sufficient flotation to the skier to comply with applicable Coast Guard requirements.

Back brace 21 is positioned outside the vest 12 against the lower portion of the back 13. The back brace is advantageously formed from relatively rigid material such as ABS plastic. Referring to FIG. 3, the back brace includes a pair of side portions 22 and 23 which are adapted to curve around the sides of the back of the wearer and an inwardly curved middle portion 24 which is adapted to support the spine of the wearer particularly in the lumbar area or the area of the mid and lower back. A pad 25 of resilient cushioning material is attached to the inside surface of the back brace.

A right strap 26 extends through a 27 (FIG. 4) in the right side portion 22 and is secured by stitching the looped end of the strap to the remainder of the strap at 28. A left strap 29 is similarly attached to the left side portion 23 of the back brace through slot 30 (FIG. 4). The straps 26 and 29 are advantageously elastic, and the front ends cf the straps are adapted to be releasably fastened together by hook and loop fasteners 31 and 32 of the type which are sold under the trademark Velcro.

Figure 2:
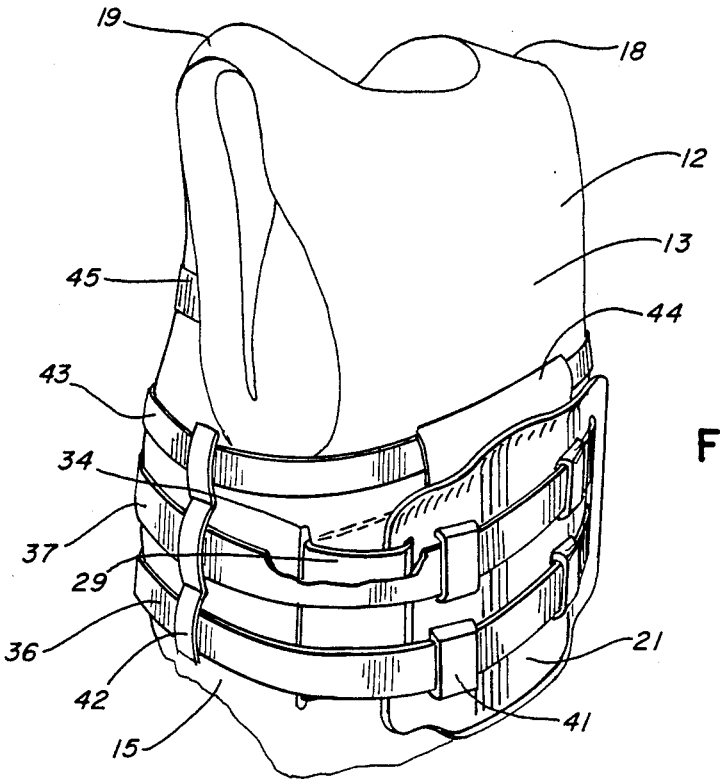
FIG. 2 is a rear perspective view of the life vest.

Each of the straps 26 and 29 extends through a slot 34 (FIG. 2) in the vest 12 in the areas where the back portion 13 meets the side portions 14 and 15. The straps 26 and 29 are adapted to extend around the waist of the skier, and the back hook and loop fasteners 31 and 32 permit the lengths of the straps 26 and 29 to be adjusted as desired to tighten the back brace 21 against the back of the skier.

A pair of nylon straps 36 and 37 extend around the outside of the back brace 21 and the outside of the vest 12 and are secured by male and female fasteners 38 and 39 (FIGS. 4 and 5) of the type which are conventionally used on life vests. At least one of the male and female fasteners on each strap is adjustably secured to the strap so that the length of the strap can be adjusted as desired.

Loops 41 (FIGS. 2 and 5) are molded into the back brace and provide slots through which the straps 36 and 37 extend. The straps also extend through fabric loops 42 (FIGS. 1 and 2) which are stiched to the sides of the vest.

A third strap 43 extends around the vest 12 above the back brace. Loop 44 is attached to the back of the vest for holding the strap 43. A fourth strap 45 extends across the upper portion of the front of the vest 12 between the armpits.

After the back brace is pulled tightly against the back and secured tightly by the straps 26 and 29, the straps 36, 37, 43, and 45 can be adjusted and secured to hold the vest relatively tightly against the body of the skier. The back brace supports the mid and lower back muscles and supports the spine, particularly in the lumbar area. The support provided by the back brace enables the skier to exert a stronger pull when crossing the wake or when making a slalom turn. The back brace also provides additional support for deep water starts which require back strength to be successful. If the skier has already suffered a back injury, the back brace reduces the likelihood that the skier will suffer additional injury.

While in the foregoing specification a detailed description of the invention is set forth for the purpose of illustration, it will be understood that many of the details herein given may be varied considerably by those skilled in the art without departing from the spirit and scope of the invention.

I claim:

1. A life vest comprising a flotation vest having a front portion, a pair of shoulder portions connecting the upper portions of the front and back portions, said back portion having a lumbar portion, said lumbar portion generally shaped to conform to the shape of a back, a back brace formed to fit the wearer of the vest and extending across said lumbar portion, and a strap connected to the back brace and having a pair of ends which are adapted to be connected in front of the wearer of the vest.

2. The life vest of claim 1 in which said back brace is positioned on the outside of the flotation vest and the strap extends through slots in the flotation vest.

3. The life vest of claim 2 including a second strap which extends around the outside of the back brace and the flotation vest.

4. The life vest of claim 3 in which the back brace is provided with slots through which the second strap extends.

5. The life vest of claim 2 in which said back brace is formed from relatively rigid material.

6. The back brace of claim 5 including a pad between the flotation vest and the back brace which is attached to the back brace.

7. The life vest of claim 5 in which said back brace includes a pair of side portions and a middle portion which curves forwardly from said side portion.

* * * * *